US012595942B2

(12) United States Patent
Depuru Guru et al.

(10) Patent No.: US 12,595,942 B2
(45) Date of Patent: Apr. 7, 2026

(54) REFRIGERANT CIRCUIT SUCTION HEAT CONTROL

(71) Applicant: TRANE INTERNATIONAL INC., Davidson, NC (US)

(72) Inventors: Bhavana Depuru Guru, La Crosse, WI (US); Jon P. Hartfield, La Crosse, WI (US); Evraam I Gorgy, Onalaska, WI (US); Erica L Gallant, Onalaska, WI (US)

(73) Assignee: TRANE INTERNATIONAL INC., Davidson, NC (US)

( * ) Notice: Subject to any disclaimer, the term of this patent is extended or adjusted under 35 U.S.C. 154(b) by 286 days.

(21) Appl. No.: 18/332,527

(22) Filed: Jun. 9, 2023

(65) Prior Publication Data

US 2024/0410628 A1 Dec. 12, 2024

(51) Int. Cl.

| | |
|---|---|
| ***F25B 40/06*** | (2006.01) |
| ***F25B 41/20*** | (2021.01) |
| ***F25B 49/02*** | (2006.01) |

(52) U.S. Cl.

CPC ..... *F25B 40/06* (2013.01); *F25B 41/20* (2021.01); *F25B 49/02* (2013.01); *F25B 2700/21* (2013.01)

(58) Field of Classification Search

CPC ..... F25B 40/06; F25B 41/20; F25B 49/02; F25B 2700/21

See application file for complete search history.

(56) References Cited

U.S. PATENT DOCUMENTS

| | | | |
|---|---|---|---|
| 5,157,936 | A | 10/1992 | Wall |
| 9,234,686 | B2 | 1/2016 | Marte et al. |
| 10,684,046 | B2 | 6/2020 | Ishiyama et al. |

(Continued)

FOREIGN PATENT DOCUMENTS

| | | | |
|---|---|---|---|
| GB | 2553970 | A | 3/2018 |
| JP | 2007093097 | A * | 4/2007 |

OTHER PUBLICATIONS

Nomoto et al., Heat Pump Water Heater and Control Method of the Same, Apr. 12, 2007, JP2007093097A, Whole Document (Year: 2007).*

(Continued)

*Primary Examiner* — Larry L Furdge
(74) *Attorney, Agent, or Firm* — HSML P.C.

(57) ABSTRACT

A method is directed to controlling superheat in a refrigerant circuit containing working fluid. The method includes directing a suction stream of the working fluid from the evaporator through the suction heat exchanger and directing the working fluid compressed by the compressor to the suction heat exchanger. The method also includes controlling a flowrate of the compressed working fluid through the suction heat exchanger. The controlling includes modulating a working fluid control valve based on a determined target saturation temperature for the compressed working fluid. A refrigerant circuit includes a main flow path, a bypass flow path, a working fluid control valve, and a controller for the refrigerant circuit. The controller configured to determine a target saturation temperature for the working fluid flowing through the suction heat exchanger in the bypass flow path, and modulate the working fluid control valve based on the target saturation temperature.

19 Claims, 2 Drawing Sheets

(56) References Cited

U.S. PATENT DOCUMENTS

| | | | | |
|---|---|---|---|---|
| 10,767,091 | B2 | 9/2020 | Sethi et al. | |
| 2006/0086115 | A1* | 4/2006 | Weber | F24F 3/153 62/196.4 |
| 2019/0309976 | A1* | 10/2019 | D'Souza | F25B 41/48 |
| 2021/0302073 | A1* | 9/2021 | Taras | F25B 49/02 |
| 2021/0396436 | A1 | 12/2021 | Hartfield et al. | |
| 2022/0146164 | A1* | 5/2022 | Long | F25B 39/00 |

OTHER PUBLICATIONS

Extended European Search Report, European Patent Application No. 24180382.4, Oct. 14, 2024 (10 pages).

* cited by examiner

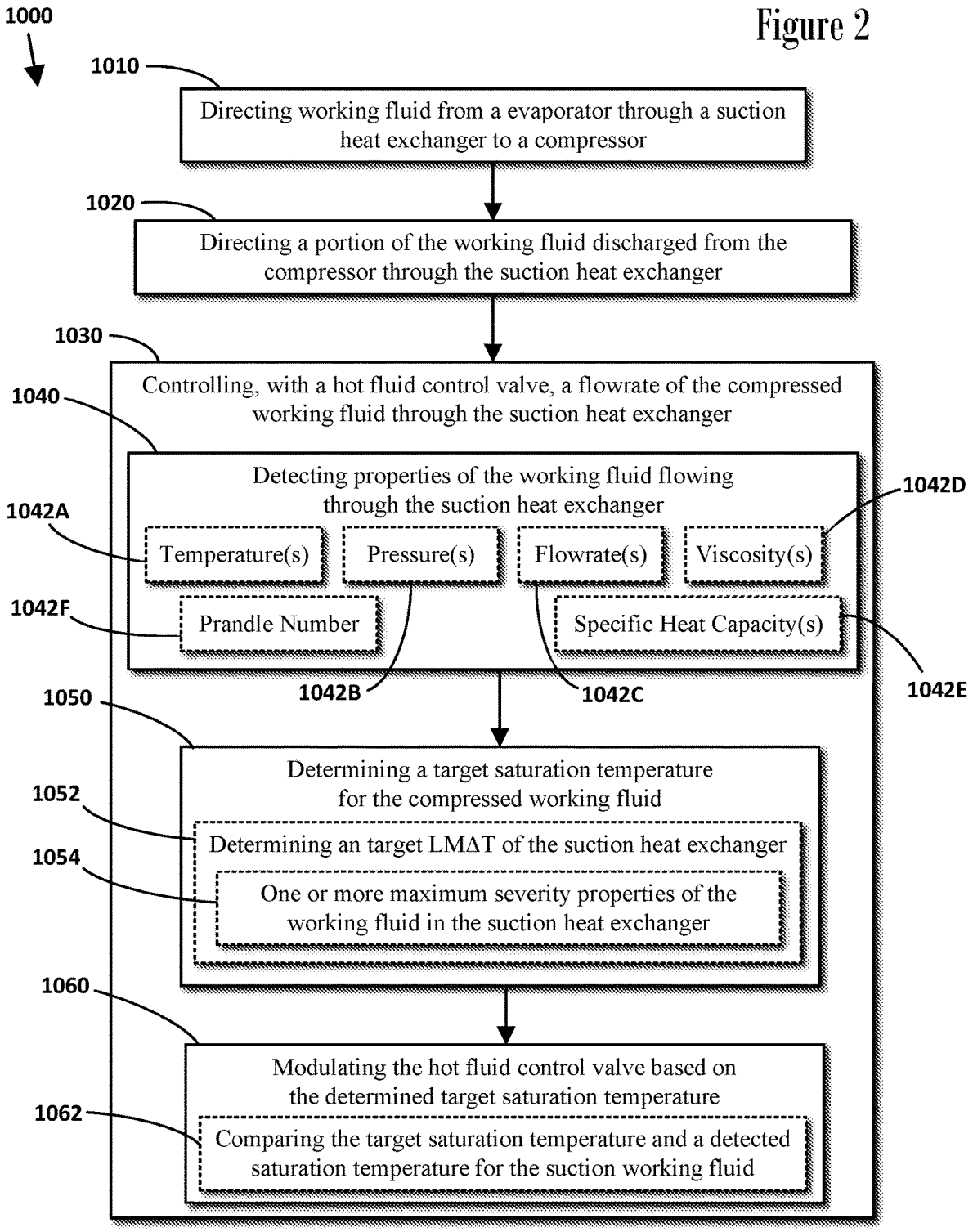
1000
Figure 2
1010
Directing working fluid from a evaporator through a suction heat exchanger to a compressor
1020
Directing a portion of the working fluid discharged from the compressor through the suction heat exchanger
1030
Controlling, with a hot fluid control valve, a flowrate of the compressed working fluid through the suction heat exchanger
1040
Detecting properties of the working fluid flowing through the suction heat exchanger
1042A
Temperature(s)
Pressure(s)
Flowrate(s)
Viscosity(s)
1042D
1042F
Prandle Number
Specific Heat Capacity(s)
1042B
1042C
1042E
1050
Determining a target saturation temperature for the compressed working fluid
1052
Determining an target LMΔT of the suction heat exchanger
1054
One or more maximum severity properties of the working fluid in the suction heat exchanger
1060
Modulating the hot fluid control valve based on the determined target saturation temperature
1062
Comparing the target saturation temperature and a detected saturation temperature for the suction working fluid

REFRIGERANT CIRCUIT SUCTION HEAT CONTROL

FIELD

This disclosure relates to heating, ventilation, air conditioning, and refrigeration ("HVACR") systems. More specifically, embodiments herein relate to controlling of refrigerant circuits for HVACR systems.

BACKGROUND

Heating, ventilation, air conditioning, and refrigeration (HVACR) systems are generally used to heat, cool, and/or ventilate an enclosed space (e.g., an interior space of a commercial building or a residential building, an interior space of a refrigerated transport unit, or the like). A HVACR system may include a refrigerant circuit for providing cooled or heated air to the area. The heat transfer circuit utilizes a working fluid to cool or heat the air directly or indirectly. Typically, a heat transfer circuit includes a compressor for compressing the working fluid. In some configurations, a working fluid may be heated prior to entering the compressor.

SUMMARY

In an embodiment, a method is directed to controlling superheat in a refrigerant circuit that includes a compressor, a condenser, an expansion device, an evaporator, and a suction heat exchanger. The refrigerant circuit contains a working fluid. The method includes directing a suction stream of the working fluid from the evaporator through the suction heat exchanger to the compressor, and directing a first portion of the working fluid compressed by the compressor from the compressor to the suction heat exchanger. The method also includes controlling, with a hot fluid control valve, a flowrate of the first portion of the working fluid into the suction heat exchanger. The controlling of the flowrate of the first portion of the working fluid includes detecting properties of the working fluid, determining a target saturation temperature for the first portion of the working fluid based on a predetermined suction superheat setpoint and the detected properties of the working fluid, and modulating the hot fluid control valve based on the determined target saturation temperature.

In an embodiment, the detecting of properties of the working fluid includes detecting a saturation temperature of the first portion of the working fluid. The modulating of the working fluid control valve is based on a difference between the determined target saturation temperature and the detected saturation temperature of the first portion of the working fluid.

In an embodiment, the detecting of the properties of the working fluid includes: detecting an inlet temperature, an outlet temperature, and a pressure of the working fluid in the suction stream flowing through the suction heat exchanger, and detecting an inlet temperature, an outlet temperature, and a pressure of the first portion of the working fluid flowing through the suction heat exchanger.

In an embodiment, the determining of the target saturation temperature includes determining a target log mean temperature difference for the suction heat exchanger based on the suction superheat setpoint and one or more of the detected properties of the working fluid. The target saturation temperature is determined based on the suction superheat setpoint, the target log mean temperature difference, and a saturation temperature of the working fluid in the suction stream.

In an embodiment, the detecting of the properties of the working fluid includes detecting one or more of a Prandtl number, a specific heat, a dynamic viscosity, and the saturation temperature of the working fluid in the suction stream based on the detected properties of the working fluid. The target log mean temperature difference is determined based on one or more of the detected Prandtl number, the detected specific heat, and the detected dynamic viscosity.

In an embodiment, the target superheat temperature is determined based on the suction superheat setpoint and one or more maximum severity properties of the suction heat exchanger.

In an embodiment, the one or more maximum severity properties of the suction heat exchanger correspond to when operating the compressor at a predetermined maximum mass flow rate and at a predetermined minimum compression setting at the predetermined maximum mass flow rate.

In an embodiment, the modulating of the working fluid control valve adjusts the working fluid control valve between different open positions.

In an embodiment, the suction stream of the working fluid flows through a first side of the suction heat exchanger, and the first portion of the working fluid flows through a second side of the suction heat exchanger. The first portion of the working fluid and the working fluid in the suction stream flowing through the suction heat exchanger exchange heat without physically mixing.

In an embodiment, the method also includes directing a second portion of the working fluid compressed by the compressor from the compressor through the condenser and an expansion device to the evaporator, and rejoining the first portion of the working fluid, after passing through the suction heat exchanger, with the second portion of the working fluid downstream of the expansion device and upstream of the evaporator.

In an embodiment, the method also includes directing the first portion of the working fluid, after passing through the suction heat exchanger, through a flow resistor prior to the rejoining of the first portion of the working fluid with the second portion of the working fluid.

In an embodiment, the method also includes cooling, with the condenser, the second portion of the working fluid with a first process fluid, expanding, with the expansion device, the second portion of the working fluid cooled in the condenser, and heating, with the evaporator, the second portion of the working fluid expanded by the expansion device with a second process fluid.

In an embodiment, a refrigerant circuit for a heating, ventilation, air conditioning, and refrigeration ("HVACR") system includes a compressor, a condenser, an expansion device, an evaporator, and a suction heat exchanger that are fluidly connected. The refrigerant circuit also includes a main flow path, a bypass flow path, a hot fluid control valve, one or more sensors, and a controller for the refrigerant circuit. The main flow path extends from the compressor through the condenser, the expansion device, the evaporator, and the suction heat exchanger, and back to the compressor. The bypass flow path extends through the suction heat exchanger. The bypass flow path extends from the main flow path downstream of the compressor and upstream of the condenser in the main flow path and extends to the main flow path downstream of the expansion device and upstream of the suction heat exchanger. The hot fluid control valve controls flow of the working fluid through the bypass flow path. The controller is configured to detect properties of the working fluid using the one or more sensors, and to determine a target saturation temperature for the working fluid in the bypass flow path flowing through the suction heat exchanger based on a suction superheat setpoint and the detected properties of the working fluid. The controller is also configured to modulate the hot fluid control valve based on the determined target saturation temperature.

In an embodiment, the controller is configured to modulate the working fluid control valve based on a difference between a detected saturation temperature of the working fluid in the bypass flow path and the determined target saturation temperature.

In an embodiment, the controller being configured to detect the properties of the working fluid includes the controller being configured to detect, using a pressure sensor of the one or more sensors, the pressure of the working fluid in the bypass flow path. The controller is also configured to determine the detected saturation temperature from the pressure of the working fluid in the bypass flow path detected by the pressure sensor.

In an embodiment, the controller is configured to detect one or more of a Prandtl number, a specific heat, a dynamic viscosity of the working fluid flowing through the suction heat exchanger in the main flow path, to detect the properties of the working fluid. The controller is also configured to determine a target log mean temperature difference for the suction heat exchanger based on the predetermined suction superheat setpoint and one or more of the Prandtl number, the specific heat capacity, and the dynamic viscosity of the working fluid in the suction stream. The target saturation temperature is determined based on the predetermined suction superheat setpoint, the target log mean temperature difference, and the saturation temperature.

In an embodiment, the target superheat temperature is determined based on the predetermined suction superheat setpoint and one or more maximum severity properties for the suction heat exchanger.

In an embodiment, the suction heat exchanger includes a first side and a second side, the main flow path extending through the first side of the suction heat exchanger, and the bypass flow path extending through the second side of the suction heat exchanger.

In an embodiment, a flow resistor disposed in the bypass flow path downstream of the suction heat exchanger.

BRIEF DESCRIPTION OF DRAWINGS

FIG. 2 is a block flow diagram of an embodiment of a method of controlling superheat in a refrigerant circuit.

Like numbers represent like features.

DETAILED DESCRIPTION

Figure 1:
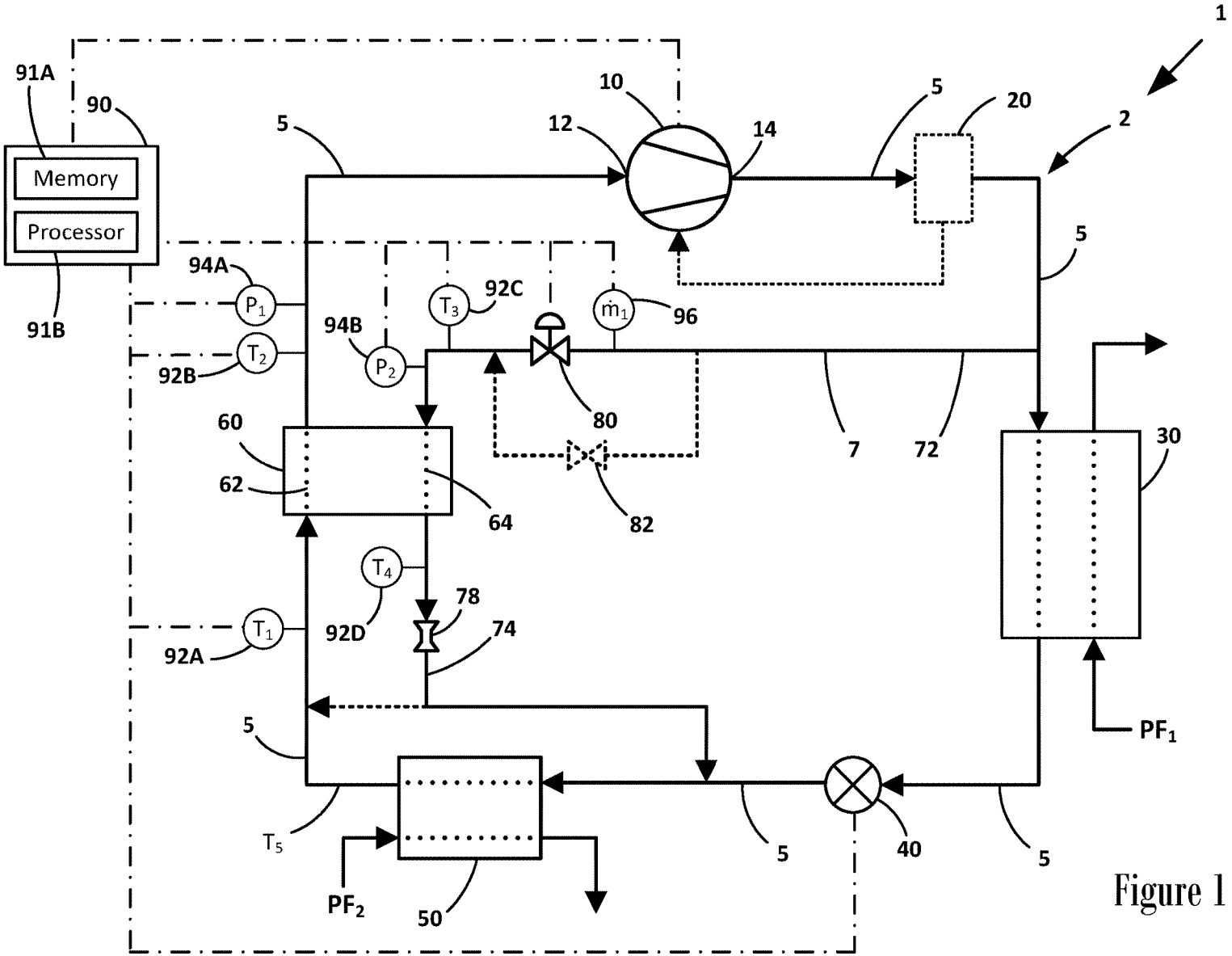
FIG. 1 is a schematic diagram of an embodiment of a refrigerant circuit for a heating, ventilation, air conditioning, and refrigeration system.

A heating, ventilation, air conditioning, and refrigeration system ("HVACR") is generally configured to heat and/or cool an enclosed space (e.g., an interior space of a commercial building or a residential building, an interior space of a refrigerated transport unit, or the like). The HVACR system includes a heat transfer circuit to heat or cool a process fluid (e.g., air, water and/or glycol, or the like). A working fluid flows through the heat transfer circuit and is utilized to heat or cool the process fluid. In an embodiment, the working fluid includes one or more refrigerants. The working fluid may heat and/or cool a process fluid directly or indirectly. For example, indirect heating and/or cooling may include the working fluid heating and/or cooling an intermediate fluid (e.g., air, water and/or glycol, or the like), and then the heated/cooled intermediate fluid heating and/or cooling the process fluid.

FIG. 1 is a schematic diagram of an embodiment of a heat transfer circuit 2 in an HVACR system 1. The heat transfer circuit 2 includes a compressor 10, a condenser 30, an expansion device 40, an evaporator 50, and a suction heat exchanger 60. Optionally, the heat transfer circuit 2 may also include a lubricant separator 20 as shown in FIG. 1. In an embodiment, the heat transfer circuit 2 can be modified to include additional components such as, for example, an economizer heat exchanger, one or more flow control devices, a receiver tank, a dryer, or the like.

The components of the heat transfer circuit 2 are fluidly connected. The heat transfer circuit 2 can be configured as a cooling system (e.g., a fluid chiller of an HVACR system, an air conditioning system, or the like) that can be operated in a cooling mode, or the heat transfer circuit 2 may be configured to operate as a heat pump system that can run in a cooling mode or a heating mode.

A working fluid flows through the heat transfer circuit 2. A flow path 5 of the working fluid through the heat transfer circuit 2 extends from the compressor 10 through the (optional) lubricant separator 20, the condenser 30, the expansion device 40, the evaporator 50, the suction heat exchanger 60, and back to the compressor 10. The working fluid includes one or more refrigerants with a lower environmental impact and may include one or more additional components as discussed above. The flow path 5 can also be referred to as the main flow path of the heat transfer circuit 2. As shown in FIG. 1, the refrigerant circuit 2 also includes a bypass flow path 7 that extends from and back to the main flow path 5. The bypass flow path 7 is described in more detail below.

Working fluid in a lower pressure gaseous state is drawn into a suction inlet 12 of the compressor 10. The working fluid is compressed as it flows from the suction inlet 12 to a discharge outlet 14 of the compressor 10. In an embodiment, the compressor 10 may be a screw compressor, a scroll compressor, centrifugal compressor, or the like. The compression of the working fluid in the compressor 10 also increases the temperature of the working fluid. Thus, the compressed working fluid discharged from the discharge outlet 14 of the compressor has a higher temperature (e.g., than at the suction inlet 12).

The compressor 10 may utilize a lubricant to lubricate its moving parts (e.g., rotor, bearings, or the like). Lubricant mixes with the working fluid flowing through the compressor 10 such that the compressed working fluid discharged from the compressor 10 contains lubricant. In an embodiment, the high pressure and temperature working fluid flows to the lubricant separator 20 (if present). The lubricant separator 20 separates lubricant from the refrigerant. For example, the lubricant separator 20 separates the liquid lubricant from the working fluid (e.g., separates the liquid lubricant from the gaseous components/refrigerant of the working fluid). The liquid lubricant may also contain dissolved refrigerant, and/or the gaseous refrigerant may contain some lubricant. The separated liquid lubricant then flows from the lubricant separator 20 back to the compressor 10 (shown by a dashed arrow in FIG. 1). The higher pressure and temperature working fluid (e.g., that includes the gaseous refrigerant) flows from the lubricant separator 20 to the condenser 30. In FIG. 1, the lubricant separator 20 is separate from the compressor 10. In an embodiment, the lubricant separator 20 may be an internal lubricant separator that is incorporated into the compressor 10 (e.g., incorporated into the same housing as the compressor 10).

In another embodiment, the lubricant may not be separated from the working fluid (i.e., does not include a lubricant separator 20) remains mixed with the working fluid within the refrigerant circuit 2. In such an embodiment, the higher pressure and temperature working fluid can flow from discharge outlet 14 of the compressor 10 to the condenser 30 without passing through a lubricant separator.

A first portion of the compressed working fluid discharged from the compressor 10 (i.e., a first portion of the higher temperature and higher pressure working fluid discharged from the compressor, and/or after flowing through the optional lubricant separator 20 when present) flows into the bypass flow path 7. In the bypass flow path 7, the first portion of the compressed working fluid flows into and through the suction heat exchanger 60 within the bypass flow path 7 (e.g., flows through a second side 64 of the suction heat exchanger 60). A second portion of the compressed working fluid discharged from the compressor 10 flows to and through the condenser 30. The second portion of the working fluid remains in the main flow path 5. The flows of the working fluid through the suction heat exchanger 60 are described in more detail below.

The condenser 30 is a heat exchanger that allows the working fluid and the first process fluid $PF_1$ to be in a heat transfer relationship within the condenser 30 without physically mixing. As the working fluid and first process fluid $PF_1$ flow through the condenser 30, the working fluid is cooled by the first process fluid $PF_1$. The process fluid $PF_1$ is heated by the working fluid and exits the condenser 30 at a higher temperature. In an embodiment, the first process fluid $PF_1$ may be air, water and/or glycol, or the like that is suitable for absorbing and transferring heat from the working fluid and the heat transfer circuit 2. For example, the first process fluid $PF_1$ may be ambient air circulated from an outside atmosphere, water to be heated as hot water, or a fluid for transferring heat from the heat transfer circuit 2. The working fluid becomes liquid or mostly liquid as it is cooled in the condenser 30.

The liquid/gas working fluid flows from the condenser 30 to the expansion device 40. The expansion device 40 allows the working fluid to expand. The expansion causes the working fluid to significantly decrease in temperature. In an embodiment, the expansion device 40 may be an expansion valve, expansion plate, expansion vessel, orifice, the like, or other such types of expansion mechanisms. It should be appreciated that the expansion device 40 may be any type of expansion device used in the field for expanding a working fluid causing the working fluid to decrease in temperature. The expansion device 40 may also be referred to as an expander.

The lower temperature gaseous/liquid working fluid then flows from the expansion device 40 to and through the evaporator 50. A second process fluid $PF_2$ also flows through the evaporator 50 separately from the working fluid. The evaporator 50 is a heat exchanger that allows the working fluid and the second process fluid $PF_2$ to be in a heat transfer relationship within the evaporator 50 without physically mixing. As the working fluid and second process fluid $PF_2$ flow through the evaporator 50, the working fluid absorbs heat from the second process fluid $PF_2$ cooling the second process fluid $PF_2$. In an embodiment, the working fluid exiting the evaporator 50 may be at or about its saturation temperature.

In an embodiment, the second process fluid $PF_2$ is air cooled by the HVACR system and ventilated to the enclosed space to be conditioned. In an embodiment, the second process fluid $PF_2$ may be an intermediate fluid (e.g., water, a heat transfer fluid, a chiller liquid, or the like) and the cooled second process fluid $PF_2$ may then be utilized by the HVACR system to cool air. The working fluid is gaseous or mostly gaseous as it exits the evaporator 50.

In some embodiments, lubricant that was entrained in gaseous working fluid exiting the lubricant separator 20 is later separated due to the temperature and/or pressure changes of the working fluid as it flows to and/or through the evaporator 50. This separated lubricant may flow to the evaporator 50 (e.g., accumulate within a particular area/volume of the evaporator 50). In an embodiment, an optional secondary lubricant flow path (not shown) may fluidly connect the evaporator 50 to the compressor 10 that is configured to allow the liquid lubricant accumulating in the evaporator 50 to flow back to the compressor 10.

The bypass flow path 7 extends through the suction heat exchanger 60. The compressed working fluid in the bypass flow path 7 flows through the suction flow path and back into the main flow path 5. As shown in FIG. 1, the bypass flow path 7 extends from the main flow path 5, through the suction heat exchanger 60, and back to the main flow path 5. The bypass flow path 7 extends from the main flow path 5 downstream of the compressor 10 and upstream of the condenser 30. The bypass flow path 7 extends to the main flow path 5 downstream of the expander 40 and upstream of the suction heat exchanger 60.

The gaseous/mostly gaseous working fluid flows from the evaporator 50 to and through the suction heat exchanger 60. The suction heat exchanger 60 further heats the working fluid discharged from the evaporator 50. The suction heat exchanger 60 heats the working fluid to increase the superheat of the working fluid and/or more completely evaporate any remaining liquid droplets in the suction stream. Superheat is a measure of the temperature change relative to the temperature at which the working fluid evaporates at a set pressure (e.g., $T(P_x)_{superheat}=T(P_x)_{Actual}-T(P_x)_{saturation}$). For example, increasing superheat of the working fluid is an increase in the temperature of the working fluid to above the saturation temperature at which the refrigerant(s) of the working fluid change state from a liquid to vapor. The heating of the working fluid within the suction heat exchanger 60 is discussed in more detail below.

The expander 40 can be configured to operate based on a superheat of the suction working fluid. For example, the expander 40 may be configured to adjust the flowrate therethrough of the working fluid based on superheat of the suction working fluid (e.g., based on the evaporator outlet temperature $T_5$ to be at a desired superheat, suction heat exchanger outlet temperature $T_2$ to be at a desired superheat). In an embodiment, the expander 40 may be an electronic expansion valve operated/controlled by a controller 90 (e.g., controlled based on detections by the sensors 92A, 92B, and/or 94A). In an embodiment, the expander 40 may be configured to operate independently of a controller 90 (e.g., a mechanical expansion valve that uses a sensing bulb, an electronic expansion valve that operates directly based on the signals from the sensors 92A, 92B, and/or 94A or separate similar temperature and/or pressure sensor(s)).

As shown in FIG. 1, the suction heat exchanger 60 includes a first side 62 and a second side 64. It should be understood that each "side" refers to a separate flow passageway through the suction heat exchanger 60, and not to a particular physical orientation. Fluids in the first side 62 and second side 64 of suction heat exchanger 60 exchange heat without physically mixing.

The main flow path 5 extends through the first side 62 of the suction heat exchanger 60. The bypass flow path 7 extends through the second side 64 of the suction heat exchanger 60. Working fluid discharged from the evaporator 50 flows to the suction heat exchanger 60, through the first side 62, and from the suction heat exchanger 60 to the compressor 10. Compressed working fluid discharged from the compressor 10 (e.g., the second portion of the compressed working fluid) flows to the suction heat exchanger 60, through the second side 64, and from the suction heat exchanger 60 into the main flow path 5. The working fluid flowing through the first side 62 of the suction heat exchanger 60 includes both the second portion of the working fluid (after passing through the condenser 30, the expander 40, and the evaporator) and the first portion of the working fluid (after passing through the suction heat exchanger 60 and optionally the evaporator 50).

In the main flow path 5, the first portion of the working fluid is split from the second portion of the working fluid downstream of the compressor 10 and upstream of the condenser 30. In the main flow path 5, the first portion of the working fluid is rejoined with the second portion of the working fluid downstream of the expander 40 and upstream of the suction heat exchanger 60. As shown in FIG. 1, the first portion and the second portion of the working fluid may be rejoined in the main flow path 5 downstream of the expander 40 and upstream of the evaporator 50. In another embodiment, the first portion and the second portion of the working fluid may be rejoined in the main flow path 5 downstream of the evaporator 50 and upstream of the suction heat exchanger 60 (e.g. as indicated by a dashed arrow in FIG. 1).

As shown in FIG. 1, the bypass flow path 7 includes a first passageway 72 (e.g., an inlet passageway) and a second passageway 74 (e.g., an outlet passageway). The first passageway 72 and the second passageway 74 fluidly connect the suction heat exchanger 60 to the main flow path 5. For example, the bypass flow path 7 is formed by the first passageway 72, the second side 64 of the suction heat exchanger 60, and the second passageway 74.

The first passageway 72 extends from the main flow path 5 to suction heat exchanger 60. The first passageway 72 is configured to direct/supply the first portion of the compressed working fluid to the second side 64 of the suction heat exchanger 60. For example, the first passageway 72 extends to the second side 64 of the suction heat exchanger 60 and directs/supplies the first portion of the compressed working fluid to the second side 64 of the suction heat exchanger 60.

The second passageway 74 extends from the suction heat exchanger 60 to the main flow path 5. The second passageway 74 is configured direct the second portion of the compressed working fluid, after passing through the suction heat exchanger 60, from the suction heat exchanger 60 back to the main flow path 5. For example, the second passageway 74 extends from the second side 64 of the suction heat exchanger 60 to the main flow path 5 and supplies the second portion of the working fluid (after passing through the suction heat exchanger 60) back to the main flow path 5. The second passageway 74 can connect to the main flow path 5 upstream of the suction heat exchanger 60 and downstream of the expander 40.

The relatively hotter and relatively higher pressure working fluid flowing through the second side 64 of the suction heat exchanger 60 (e.g., the second portion of the compressed working fluid) heats the relatively colder and relatively lower pressure working fluid flowing through the first side 62 of the suction heat exchanger 60. The refrigerant circuit 2 includes a compressed fluid control valve 80 that controls the mass flowrate of the relatively hotter, compressed working fluid through suction heat exchanger 60 (e.g., through the second side 64 of the suction heat exchanger 60). The compressed working fluid control valve 80 may also be referred to as a hot fluid control valve, hot gas control valve, a working fluid control valve, a bypass control valve, a suction heat exchanger ("SHX") control valve, or the like. For example, the hot fluid control valve 80 controls the amount (e.g., a percentage) of the compressed working fluid discharged from the compressor 10 is redirected into the suction heat exchanger 60 instead of the condenser 30. The hot fluid control valve 80 is controlled/operated by the controller 90. In an embodiment, the expander 40 is configured to operate separate from the hot fluid control valve 80. This can advantageously help ensure that the suction working fluid has at least some superheat. Control of the hot fluid control valve 80 is discussed in more detail below.

As shown in FIG. 1, the hot fluid control valve 80 may be disposed in the bypass flow path 7 upstream of the suction heat exchanger 60 (e.g., the bypass flow path 7 extends through the hot fluid control valve 80). For example, the inlet/first passageway 72 of the bypass flow path 7 includes the hot fluid control valve 80. In an embodiment, the refrigerant circuit 2 may include an auxiliary hot gas valve 82 disposed in parallel with the hot fluid control valve 80. When included, the auxiliary hot gas valve 82 may be included and used as a bypass valve for the hot fluid control valve 80 (e.g., when an issue occurs with the hot fluid control valve 80).

In an embodiment, the hot fluid control valve 80 is an electric flow control valve that is adjustable to control the flowrate of the working fluid through the hot fluid control valve (e.g., has an opening that is adjustable to change the amount of working fluid flowing through the valve). An "electronic" flow control valve is driven by an electronic motor to adjust the degree that the valve is open (e.g., to vary the amount of working fluid flowing through the expansion valve). A "position" of the hot fluid control valve 80 refers to the extent that valve is opened or closed. The positions of the hot fluid control valve 80 include a first position (e.g., a 100% open position), a second position (e.g., a 100% closed position or a 0% open positon), and a plurality of intermediate positions (i.e., steps) between the first and second positions (e.g., 90% open, 80% open, 70% open, 60% open, and the like). The number of intermediate positions can be selected based on a desired sensitivity for the valve. For example, the valve may have, but is not limited to, 10s of positions, 100s of positions, 1000s of positions, or the like based on its desired flow control. In an embodiment, the hot fluid control valve may have at least 10 positions. Control of the hot fluid control valve 80 is discussed in more detail below.

As shown in FIG. 1, the refrigerant circuit 2 may include a flow resistor 78. The flow resistor 78 is disposed downstream of suction heat exchanger 60 in the bypass flow path 7. The compressed working fluid discharged from the suction heat exchanger 60 flows through the flow resistor 78 before flowing back into the main flow path 5. For example, the outlet/second passageway 74 of the bypass flow path extends through the flow resistor 78 (e.g., the second passageway 74 includes the flow resistor 78).

The flow resistor 78 is a restriction that provides a resistance to flow out of the compressed working fluid. In an embodiment, the flow resistor 78 is an orifice that restricts flow of the compressed working fluid from the suction heat exchanger 60. For example, the flow resistor 78 has a relatively smaller area in the bypass flow path (e.g., smaller cross-sectional area than other portions of the bypass flow path 7, smaller cross-sectional area than the first passageway 7, and the like).

The flow resistor 78 is configured to prevent accumulation of liquid working fluid within the suction heat exchanger 60. Under some operating conditions, the compressed working fluid may partially condense within the suction heat exchanger 60. The flow resistor 78 has a size (e.g., cross-sectional area) that is configured to cause any/all liquid condensate working fluid and at least some gaseous working fluid of the compressed working to be discharged from the suction heat exchanger 60. The size of the flow resistor 78 is configured to cause at least at some gaseous phase of the compressed working fluid to be discharged and flow from the suction heat exchanger 60 (e.g., flows through the second passageway 74). For example, the size of the flow resistor 78 ensures at least some gaseous phase of the compressed working fluid is discharged from the suction heat exchanger 60 when operating at maximum severity. This operation of the flow resistor 78 is with respect to normal operation of the refrigerant circuit 5 (e.g., steady state operation, not during startup of the refrigerant circuit 2, not during shutdown of the refrigerant circuit 2). In an embodiment, the flow resistor 78 is configured to have a fixed configuration (e.g., fixed size) during normal operation of the refrigerant circuit 5. The flow resistor 78 is configured to help maintain a desired flow through the suction heat exchanger 60. For example, the flow resistor 78 can help prevent the occurrence of an undesired, relatively high flow through the suction heat exchanger 60 that might occur when the pressure downstream of the valve 40 is very low. Maximum severity operation is discussed in more detail below.

The refrigerant circuit 2 includes a controller 90 for controlling operation of refrigerant circuit 2 and its components. In an embodiment, the controller 90 may be the controller of the HVACR system 1. In an embodiment, the controller 90 may be the controller of the compressor 10. In an embodiment, the controller 90 includes memory 91A for storing information and a processor 92A. The control schemes, operations, and information relevant to such control schemes and operations for the refrigerant circuit 2 and its components (e.g., the compressor 10, the expander 40, the hot fluid control valve 80) as described herein may be stored on the memory 91A. For example, the operations described below for method 1000 in FIG. 2 may be stored on the controller 90. The controller 90 in FIG. 1 and described below is described/shown as a single component. However, it should be appreciated that a "controller" as shown in the Figures and described herein may include multiple discrete or interconnected components that include the memory 91A and a processor 91B in an embodiment.

Dotted lines are provided in the Figures to indicate fluid flows through the heat exchangers (e.g., condenser 30, evaporator 50, suction heat exchanger 60), and should be understood as not specifying specific flow paths for the fluid flows through the heat exchangers. Dashed and dotted lines are provided in the Figures to illustrate electronic communications between different features. For example, dashed and dotted lines are provided between the controller 90 and different components that are used, controlled, and the like by the controller 90. For example, a dashed dotted line extends from the controller 90 to the compressor 10 as the controller 90 can be configured to control operation the compressor 10 (e.g., speed of the compressor when adjustable, discharge pressure of the compressor 10 when adjustable, and the like).

For example, dashed dotted lines extend between temperature sensors 92A, 92B, 92C, 92D and controller 90 as the controller 90 receives temperatures readings from the temperature sensors 92A, 92B, 92C, 92D of the working fluid in the refrigerant circuit 2. The temperature sensor 92A and the temperature sensor 92B are disposed in the main flow path 5 and can be used to detect the inlet temperature $T_1$ and the outlet temperature $T_2$ of the suction working fluid into and out of the suction heat exchanger 60, respectively (e.g., of the suction working entering and discharged from the suction heat exchanger 60, of the working fluid flowing into and discharged from the first side 62 of the suction heat exchanger 60). The temperature sensor 92C and the temperature sensor 92D are disposed in bypass flow path 7 and can be used to detect the inlet temperature $T_3$ and the outlet temperature $T_4$ of the compressed working fluid into and out of the suction heat exchanger 60, respectively (e.g., of the compressed working entering and discharged from the suction heat exchanger 60, of the working fluid flowing into and discharged from the second side 64 of the suction heat exchanger 60).

For example, dashed dotted lines extend between pressure sensors 94A, 94B and controller 90 as the controller 90 receives pressure readings from the pressure sensors 94A, 94B of the working fluid in the refrigerant circuit 2. For example, pressure sensor 94A is disposed in the main flow path 5 and can be used detect the pressure $P_1$ of the suction working fluid flowing through the suction heat exchanger 60 (e.g., of the working fluid flowing through the first side 62 of the suction heat exchanger 60). For example, pressure sensor 94B is disposed in the bypass flow path 7 and can be used detect the pressure $P_2$ of the compressed working fluid flowing through the suction heat exchanger 60 (e.g., of the working fluid flowing through the second side 64 of the suction heat exchanger 60).

For example, the mass flow sensor 96 is disposed in bypass flow path to detect the mass flow rate $\dot{m}_1$ of the compressed working fluid flowing through the suction heat exchanger 63 (e.g., flowing into and through the bypass flow path). The mass flow sensor 96 may be mass flow sensor configured to detect the mass flow rate directly or may be a volumetric flow rate sensor used to detect the mass flow rate indirectly (e.g., also using the detections from the pressure sensor 94B and/or temperature sensor 92C).

It should be appreciated that the sensors 92A, 92B, 94C, 94D, 94A, 94B, 96 may be used to indirectly detect other properties of the working fluid. Such properties may include, but are not limited do, saturation temperature, viscosity, dynamic viscosity, specific heat capacity, Prandtl Number, or the like of the working fluid flowing through the suction heat exchanger 60 (e.g., of the suction working fluid flowing in the first side 62 of the suction heat exchanger 60, of the compressed working fluid flowing in the second side 64 of the suction heat exchanger 60). The pressure sensor 94A may be used to indirectly detect a saturation temperature of the suction working fluid flowing through/in the suction heat exchanger (e.g., calculating saturation temperature from a detected pressure using a previously determined pressure-saturation temperature relationship of the working fluid). The pressure sensor 94B may be used to indirectly detect a saturation temperature of the compressed working fluid flowing through/in the suction heat exchanger 60.

FIG. 2 is a block flow diagram of a method 1000 of controlling compressor suction superheat in a refrigerant circuit. For example, the method 1000 may be for controlling compressor suction superheat in the refrigerant circuit 2 in FIG. 1. In an embodiment, the method 1000 may be implemented by a controller (e.g., controller 90) of the refrigerant circuit. For example, operations for in implementing the method 1000, and any relevant information used in implementing the method 1000, may be stored in the memory 91A of the controller 90.

The refrigerant circuit includes a working fluid. The refrigerant circuit includes a compressor (e.g., compressor 10), a condenser (e.g., condenser 30), an expander (e.g., expander 40), an evaporator (e.g., evaporator 50), a suction heat exchanger (e.g., suction heat exchanger 60), and a hot fluid control valve (e.g., hot fluid control valve 80). In an embodiment, the method 1000 may be employed for a normal operation of the refrigerant circuit (e.g., not during a shutdown and/or during a startup of the refrigerant circuit). The method 1000 starts at 1010.

At 1010, the working fluid discharged from the evaporator is directed through the suction heat exchanger to a compressor. This working fluid can also be referred to as suction working fluid. For example, the directing of the suction working fluid through the suction heat exchanger at 1010 includes passing the working fluid through a first side (e.g., first side 62) of the suction heat exchanger. In an embodiment, the working fluid is directed through a main flow path (e.g., main flow path 5) of the refrigerant circuit in 1010. The method 1000 then proceeds from 1010 to 1020.

At 1020, a portion of the working fluid discharged from the compressor is directed through the suction heat exchanger. This working fluid can be referred to as the compressed working fluid (e.g., working fluid compressed and discharged from the compressor, the working fluid at a relatively higher pressure within the refrigerant circuit 2). For example, the directing of the compressed working fluid through the suction heat exchanger at 1020 includes passing the compressed working fluid through a second side (e.g., second side 64) of the suction heat exchanger. The suction working fluid absorbs heat from the compressed working fluid as they each flow through the suction heat exchanger, which further heats the suction working fluid.

In an embodiment, the portion of working fluid is directed at 1020 from the main flow path through a bypass flow path (e.g., bypass flow path 7) and back to the main flow path in the refrigerant circuit. The directing of the compressed working fluid at 1020 can include passing the compressed working fluid through the suction heat exchanger then through a flow restrictor (e.g., flow restrictor 78). For example, the compressed working fluid discharged from the suction heat exchanger is passed through the flow restrictor (e.g., flows through the suction heat exchanger and then the flow restrictor in series in the bypass flow path). The compressed working fluid, after passing through the suction heat exchanger and the restrictor, flow from the restrictor back into the main flow path (e.g., flows from the bypass flow path into the main flow path 5).

The portion of working fluid directed through the suction heat exchanger at 1020 can be a first portion of the working fluid discharged from the compressor (e.g., compressor). A second portion of the working fluid discharged from the compressor is directed through the condenser and the expander to the evaporator. The suction working fluid directed at 1010 includes the second portion of the working fluid, after passing through the condenser, the expander, and the evaporator. For example, the first portion and the second portions of the working fluid can be rejoined downstream of the expander and upstream of compressor in the main flow path of the refrigerant circuit. The method 1000 then proceeds from 1020 to 1030.

At 1030, a flowrate of the compressed working fluid to the suction heat exchanger is controlled using the hot fluid control valve. The flowrate of the compressed working fluid is controlled at 1030. The flowrate of the compressed working fluid is controlled based on a suction superheat setpoint, as described in more detail below.

The controlling of the flowrate at 1030 includes detecting properties of the working fluid flowing through the suction heat exchanger at 1040. In an embodiment, the properties may be detected at 1040 using one or more sensors (e.g., sensor(s) 92A-D, 94A, 94B, 96) for the refrigerant circuit. The properties detected at 1040 can include, but are not limited to, at least one of one or more temperature(s) 1042A of the working fluid, one or more pressure(s) 1042B of the working fluid, one or more flowrate(s) 1042C of the working fluid, one of more viscosity(s) 1042D, one or more specific heat capacity(s) of the working fluid, and/or one or more Prandtl Number(s) 1042F of the working fluid.

The detected temperature(s) 1042A can include one or more of an inlet temperature (e.g., inlet temperature $T_1$) of the suction fluid, an outlet temperature (e.g., outlet temperature $T_2$) of the suction working fluid, an inlet temperature (e.g., inlet temperature $T_3$) of the compressed working fluid, and/or an outlet temperature (e.g., outlet temperature $T_4$) of the compressed working fluid into/from the suction heat exchanger. Inlet temperature refers to the temperature of the working fluid flowing into the suction heat exchanger and outlet temperature refers to the temperature of the working fluid flowing out of (e.g., discharged from) the suction heat exchanger. For example, each of said temperature(s) 1042A may be detected directly using a respective temperature sensors of the refrigerant circuit (e.g., refrigerant sensors 92A, 92B, 92C, 92D).

The detected pressure(s) 1042B can include one or more of the pressure (e.g., pressure $P_1$) of the suction working fluid and/or the pressure (e.g., pressure $P_2$) of the compressed working fluid in the suction heat exchanger. The properties detected at 1040 may include a saturation temperature of the compressed working fluid and/or a saturation temperature of the suction working fluid. For example, the saturation temperature of the compressed/suction working fluid may be detected indirectly from its pressure as detected at 1042B.

The detected flowrate(s) 1042C can include a flowrate (e.g., mass flow rate $\dot{m}$) of the compressed working fluid flowing through the suction heat exchanger (e.g., through the first side of the suction heat exchanger). The flowrate(s) 1042C may also include a flowrate of the heated working fluid flowing through the suction heat exchanger (e.g., through the second side of the section heat exchanger). The flowrate(s) 1042C can be the mass flowrate of the working fluid. The method 1000 then proceeds from 1040 to 1030.

The detected viscosity(s) 1042D may include the viscosity of the compressed working fluid and/or the viscosity of the suction working fluid. The viscosity/dynamic viscosity may be detected indirectly from other directly detected properties of the working fluid (e.g., using a temperature, a pressure, and/or a flow rate of the working fluid as detected at 1042A, 1042B, 1042C). The detected viscosity 1042D may be the dynamic viscosity of the working fluid.

The detected specific heat capacity(s) 1042E may include the specific heat capacity of the compressed working fluid and/or the specific heat capacity of the suction working fluid.

The viscosity/dynamic viscosity may be detected indirectly from other directly detected properties of the working fluid (e.g., using a temperature, a pressure, and/or a flow rate of the working fluid as detected at 1042A, 1042B, 1042C).

As shown in FIG. 2, the controlling of the flowrate at 1030 also includes determining a target saturation temperature for the compressed working fluid in the suction heat exchanger at 1050. The target saturation temperature is determined based on a suction superheat setpoint and the working fluid properties detected at 1040. The target saturation temperature (for the compressed working fluid) is for providing an optimal amount of thermal energy to the suction working fluid within the suction heat exchanger. The target saturation temperature is discussed in more detail below.

The suction superheat setpoint is the desired superheat for the suction stream of the compressor. The suction superheat setpoint superheat can be a value previously provided by a user. For example, the suction superheat setpoint may be stored in the memory of the controller (e.g., memory 91A of controller 90). In an embodiment, a value for the predetermined suction superheat setpoint may be based on the working fluid (e.g., the type(s) of refrigerant in the working fluid, the type(s) of lubricant (e.g., oil) in the working fluid, and the like). In an embodiment, the value for the suction superheat setpoint may, additionally or alternatively, be based on the properties of the compressor (e.g., compressor type, compressor configuration, current operation of the compressor, and the like). For example, the suction superheat setpoint may be variable value that is determined based on the current operation of the compressor 10 (e.g., the predetermined variable value being a stored formula, a stored table, or the like). In an embodiment, the suction superheat setpoint can be predetermined suction superheat setpoint (e.g., a predetermined set value, a predetermined variable value, or like). The suction superheat setpoint can also be referred to herein as the superheat setpoint for brevity. In an embodiment, the superheat setpoint is at least 5° F. In an embodiment, the superheat setpoint is at least 8° F. In an embodiment, the superheat setpoint is from at or about 5° F. to at or about 10° F. In an embodiment, the superheat setpoint is from at or about 8° F. to at or about 10° F.

In an embodiment, the determining of the target saturation temperature at 1050 may include determining a target log mean temperature difference ("LMAT") for the suction heat exchanger based on the suction superheat setpoint ("suction SSP") and one or more detected properties of the working fluid flowing through the suction heat exchanger (e.g., the one or more properties detected at 1040). The target LMAT for the suction heat exchanger determined may be based on the predetermined suction SSP and one or more detected properties of the working fluid flowing through the suction heat exchanger (e.g., the one or more properties detected at 1040).

In an embodiment, the target LMAT can be determined at 1060 based on the predetermined suction SSP and a specific heat capacity, a mass flow rate, and a Prandtl Number of the suction working fluid flowing through the suction heat exchanger. The target log mean temperature difference may also be determined based on one or more maximum severity properties of the suction heat exchanger.

Maximum severity properties are properties of the working fluid in the suction heat exchanger when the refrigerant circuit is operating at a maximum severity setting. The maximum severity setting is a normal operating setting of the refrigerant circuit that operates the suction heat exchanger at its most severe thermal conditions. For example, at the maximum severity setting, the suction heat exchanger provides a high/maximum heating for the suction working fluid while having a low/smallest temperature difference between the working fluids in the suction heat exchanger. The maximum severity setting can be a normal state operation of the refrigerant circuit (e.g., not a startup or a shutdown of the refrigerant circuit) that provides the greatest flowrate for the suction working fluid through the suction heat exchanger and the lowest temperature difference between the streams of working fluid in the suction heat exchanger. For example, the predetermined maximum severity setting corresponds to operating of the compressor at a predetermined maximum mass flow rate (e.g., a predetermined maximum speed) and at a predetermined minimum compression (e.g., at a lowest pressure differential) for said predetermined maximum mass flow rate. The maximum mass flow rate and lowest pressure differential are for predetermined settings of the compressor (e.g., from an operating map for the compressor). The maximum severity properties can be determined from previous testing of the suction heat exchanger, computational modeling of the suction heat exchanger, or the like, and stored in the memory of the controller of the refrigerant circuit (e.g., in the memory 91A of the controller 90).

In one example, the target LMAT may be determined at 1050 according to formula (1) below. The "*" superscript indicates a property is a maximum severity property of the working fluid in the suction heat exchanger. An "s" subscript indicates a property is for the suction working fluid flowing through the suction heat exchanger. For example, $Pr_S$ corresponds to a property (i.e., Prandtl Number) of the suction fluid in the suction heat exchanger in its present operation (e.g., based on the detected properties at 1040), while $Pr_S$* corresponds to the same property (i.e., Prandtl number) of the suction fluid in the suction heat exchanger when operating at maximum severity.

$$\text{Target}\,\Delta T_{LM} = \Delta T_{LM}^{*} \cdot \left(\frac{\dot{m}_c^{*}}{\dot{m}_c}\,\frac{\mu_c}{\mu_c^{*}}\right)^{n} \cdot \left(\frac{Pr_c^{*}}{Pr_c}\right)^{m} \cdot \left(\frac{\dot{m}_c C_{p,c} SSP}{\dot{m}_c^{*} C_{p,c}^{*} \Delta T_c^{*}}\right) \quad (1)$$

Target $\Delta T_{LM}$=Target log mean temperature difference
SSP=Suction superheat setpoint
$Pr_S$=Prandtl number of the suction working fluid flowing (e.g., detected at
$\mu_S$=Dynamic viscosity of the suction working fluid
$\dot{m}_S$=Mass flow rate of the suction working fluid
$C_{p,S}$=Specific heat capacity of the suction working fluid
$\Delta T_{LM}$=LMTD of the suction heat exchanger
n=First constant (e.g., 0.8)
m=Second constant (e.g., 0.4)

The target LMAT for the suction heat exchanger determined is based on the suction SSP and one or more detected properties of the working fluid flowing through the suction heat exchanger (e.g., the one or more properties detected at 1040). In an embodiment, the target saturation temperature at 1050 may be determined based the suction SSP, the target LMAT (e.g., as determined at 1060), and one or more detected properties of the working fluid (e.g., properties detected at 1040). In one example, the target saturation temperature at 1050 can be determined based on the suction SSP, the target LMAT, and the saturation temperature of the suction working fluid in the suction heat exchanger. In one example, the target saturation temperature may be determined at 1050 according to formula (2) below.

$$\text{Target } T_{Sat,H} = \frac{T_{Sat,S} - (T_{Sat,S} + SSP) \cdot e^{\left(\frac{SSP}{Target\Delta T_{LM}}\right)}}{1 - e^{\left(\frac{SSP}{Target\Delta T_{LM}}\right)}} \quad (2)$$

Target $T_{Sat,H}$=Target Saturation Temperature for the hot working fluid $T_{Sat,S}$=Detected saturation temperature of suction working fluid Target $\Delta T_{LM}$=Target log mean temperature difference (e.g., as determined at 1052)

SSP=Suction superheat setpoint

At 1060, the hot fluid control valve is modulated based on the target saturation temperature determined at 1050. The term "modulating" refers to adjusting of hot fluid control valve between different open positions (e.g., partially opening and/or partially closing). For example, the hot fluid control valve is moved between its intermediate positions (e.g., between positions not that are not a fully open or 100% open position and a fully closed or 0% open position). The modulating at 1060 adjusts the position of the hot fluid control valve based on the target saturation temperature. In an embodiment, the modulating at 1060 may include one or more of adjusting the hot fluid control valve to a more open position and adjusting the suction to a less open position.

In an embodiment, the hot fluid control valve can be modulated at 1060 based on the target saturation temperature and a detected saturation temperature of the compressed working fluid in the working fluid. For example, the detected saturation temperature may be detected at 1040 (e.g., indirectly detected from the pressure $P_2$ of the compressed working fluid). The modulation of the hot fluid control valve at 1060 may include comparing the target saturation temperature and the detected saturation temperature at 1062. In such an embodiment, the modulation of the hot fluid control valve at 1060 is based on the comparison at 1062.

The modulation at 1060 may be a proportional adjustment of the hot fluid control valve based on the comparison of the target saturation temperature and the detected saturation temperature at 1062. The proportion adjustment is proportional to the difference between the target saturation temperature and the detected saturation temperature. For example, when the detected saturation temperature is larger than the target saturation temperature, the hot fluid control valve can be partially opened further (e.g., opened by an amount proportional to the difference therebetween); and when the detected saturation temperature is smaller than the target saturation temperature, then the hot fluid control valve can be partially closed (e.g., closed by an amount proportional to the difference therebetween). The correlation/relationship between the amount of adjustment of the hot fluid control valve and the difference between the detected saturation temperature and the target saturation temperature can be based on previous testing, computational modeling, or the like. For example, this correlation/relationship can be stored in the memory of the controller (e.g., memory 91A) of the refrigerant circuit.

In the method 1000, the hot fluid control valve may be controlled/adjusted without directly using the outlet temperature (e.g., outlet temperature $T_2$) of suction working fluid. In contrast, use of the outlet temperature directly would adjust the hot fluid control valve using a comparison/difference between the outlet temperature of the suction working fluid and the temperature for the predetermined minimum compressor suction superheat. Such direct use of the outlet temperature of the suction working fluid from the suction heat exchanger can cause negative interactions between the controlling/operation of the expander and the controlling/operation of the hot fluid control valve (e.g., adjustment by the expander cause adjustment by the hot fluid control valve causing a further adjustment by the expander, which can then continuously repeat). In an embodiment, the method 1000 can help advantageously minimize such negative control interactions in its control of the suction heat.

In an embodiment, the use of the target saturation temperature in the method 1000 can also help advantageously ensure that an adequate flow of (gaseous) compressed working fluid passes through and is discharged from the suction heat exchanger. Such flow of (gaseous) compressed working fluid can help keep any liquid/condensed working fluid from accumulating within the suction heat exchanger. For example, accumulating of liquid compressed working fluid in the suction heat exchanger can reduce efficiency of the suction heat exchanger. In an embodiment, the method 1000 may ensure the It should be appreciated that the method 1000 in an embodiment may be modified to have one or more features as shown and/or described above for the refrigerant circuit 2 in FIG. 1. For example, the method 1000 in an embodiment may be modified to include the compressing of the working fluid with the compressor, the condensing of the other portion of the compressed working fluid with the condenser, the expanding of the working fluid with the expander, and the heating of the expanded working fluid in the evaporator, as described above for the refrigerant circuit 2. For example, the method 1000 in an embodiment may be modified to include the controlling of the expander that is separate from the controlling of the suction heat exchanger (e.g., controlling of the hot fluid control valve at 1030).

Aspects:

Any of Aspects 1-12 may be combined with any of Aspects 13-19.

Aspect 1. A method of controlling superheat in a refrigerant circuit, the refrigerant circuit including a compressor, a condenser, an expander, an evaporator, a suction heat exchanger, the refrigerant circuit containing a working fluid, the method comprising: directing a suction stream of the working fluid from the evaporator through the suction heat exchanger to the compressor; directing a first portion of the working fluid compressed by the compressor from the compressor to the suction heat exchanger; and controlling, with a working fluid control valve, a flowrate of the first portion of the working fluid into the suction heat exchanger, which includes: detecting properties of the working fluid, determining a target saturation temperature for the first portion of the working fluid based on a suction superheat setpoint and the detected properties of the working fluid, and modulating the working fluid control valve based on the determined target saturation temperature.

Aspect 2. The method of Aspect 1, wherein the detecting of properties of the working fluid includes detecting a saturation temperature of the first portion of the working fluid, and the modulating of the working fluid control valve is based on a difference between the determined target saturation temperature and the detected saturation temperature of the first portion of the working fluid.

Aspect 3. The method of any one of Aspects 1-2, wherein the detecting of the properties of the working fluid includes: detecting an inlet temperature, an outlet temperature, and a pressure of the working fluid in the suction stream flowing through the suction heat exchanger, and detecting an inlet temperature, an outlet temperature, and a pressure of the first portion of the working fluid flowing through the suction heat exchanger.

Aspect 4. The method of any one of Aspects 1-3, wherein the determining of the target saturation temperature includes determining a target log mean temperature difference for the suction heat exchanger based on the suction superheat setpoint and one or more of the detected properties of the working fluid, and the target saturation temperature is determined based on the suction superheat setpoint, the target log mean temperature difference, and a saturation temperature of the working fluid in the suction stream.

Aspect 5. The method of Aspect 4, wherein the detecting of the properties of the working fluid includes detecting one or more of a Prandtl number, a specific heat, a dynamic viscosity, and the saturation temperature of the working fluid in the suction stream based on the detected properties of the working fluid, and the target log mean temperature difference is determined based on one or more of the detected Prandtl number, the detected specific heat, and the detected dynamic viscosity.

Aspect 6. The method of any one of Aspects 1-5, wherein the target superheat temperature is determined based on the suction superheat setpoint and one or more maximum severity properties of the suction heat exchanger.

Aspect 7. The method of Aspect 6, wherein the one or more maximum severity properties of the suction heat exchanger correspond to when operating the compressor at a predetermined maximum mass flow rate and at a predetermined minimum compression setting at the predetermined maximum mass flow rate.

Aspect 8. The method of any one of Aspects 1-7, wherein the modulating of the working fluid control valve adjusts the working fluid control valve between different open positions.

Aspect 9. The method of any one of Aspects 1-8, wherein the suction stream of the working fluid flows through a first side of the suction heat exchanger, the first portion of the working fluid flows through a second side of the suction heat exchanger, and the first portion of the working fluid and the working fluid in the suction stream flowing through the suction heat exchanger exchange heat without physically mixing.

Aspect 10. The method of any one of Aspects 1-9, further comprising: directing a second portion of the working fluid compressed by the compressor from the compressor through the condenser and an expander to the evaporator; and rejoining the first portion of the working fluid, after passing through the suction heat exchanger, with the second portion of the working fluid downstream of the expander and upstream of the evaporator.

Aspect 11. The method of Aspect 10, further comprising: directing the first portion of the working fluid, after passing through the suction heat exchanger, through a flow resistor prior to the rejoining of the first portion of the working fluid with the second portion of the working fluid.

Aspect 12. The method of any one of Aspects 10-11, further comprising: cooling, with the condenser, the second portion of the working fluid with a first process fluid; expanding, with the expander, the second portion of the working fluid cooled in the condenser, and heating, with the evaporator, the second portion of the working fluid expanded by the expander with a second process fluid.

Aspect 13. A refrigerant circuit for a heating, ventilation, air conditioning, and refrigeration (HVACR) system, comprising: a compressor, a condenser, an expander, an evaporator, and a suction heat exchanger being fluidly connected; a main flow path extending from the compressor through the condenser, the expander, the evaporator, and the suction heat exchanger, and back to the compressor; a bypass flow path extending through the suction heat exchanger, the bypass flow path extending from the main flow path downstream of the compressor and upstream of the condenser in the main flow path, the bypass flow path extending to the main flow path downstream of the expander and upstream of the suction heat exchanger; a working fluid control valve for controlling flow of the working fluid through the bypass flow path; one or more sensors; a controller for the refrigerant circuit, the controller configured to: detect, using the one or more sensors, properties of the working fluid, determining a target saturation temperature for the working fluid in the bypass flow path flowing through the suction heat exchanger based on a predetermined suction superheat setpoint and the detected properties of the working fluid, and modulate the working fluid control valve based on the determined target saturation temperature.

Aspect 14. The refrigerant circuit of Aspect 13, wherein the controller is configured to modulate the working fluid control valve based on a difference between a detected saturation temperature of the working fluid in the bypass flow path and the determined target saturation temperature.

Aspect 15. The refrigerant circuit of any one of Aspects 13-14, wherein the controller being configured to detect the properties of the working fluid includes the controller being configured to detect, using a pressure sensor of the one or more sensors, the pressure of the working fluid in the bypass flow path, and the controller is configured to determine the detected saturation temperature from the pressure of the working fluid in the bypass flow path detected by the pressure sensor.

Aspect 16. The refrigerant circuit of Aspect 15, wherein the controller is configured to: detect one or more of a Prandtl number, a specific heat, a dynamic viscosity of the working fluid flowing through the suction heat exchanger in the main flow path, to detect the properties of the working fluid, and determine a target log mean temperature difference for the suction heat exchanger based on the predetermined suction superheat setpoint and one or more of the Prandtl number, the specific heat capacity, and the dynamic viscosity of the working fluid in the suction stream, and wherein the target saturation temperature is determined based on the predetermined suction superheat setpoint, the target log mean temperature difference, and the saturation temperature.

Aspect 17. The refrigerant circuit of any one of Aspects 13-16, wherein the target superheat temperature is determined based on the predetermined suction superheat setpoint and one or more maximum severity properties for the suction heat exchanger.

Aspect 18. The refrigerant circuit of any one of Aspects 13-17, wherein the suction heat exchanger includes a first side and a second side, the main flow path extending through the first side of the suction heat exchanger, and the bypass flow path extending through the second side of the suction heat exchanger.

Aspect 19. The refrigerant circuit of any one of Aspects 13-18, further comprising: a flow resistor disposed in the bypass flow path downstream of the suction heat exchanger.

The terminology used herein is intended to describe particular embodiments and is not intended to be limiting. The terms "a," "an," and "the" include the plural forms as well, unless clearly indicated otherwise. The terms "comprises" and/or "comprising," when used in this Specification, specify the presence of the stated features, integers, steps, operations, elements, and/or components, but do not preclude the presence or addition of one or more other features, integers, steps, operations, elements, and/or components. In an embodiment, "connected" and "connecting" as described herein can refer to being "directly connected" and "directly connecting".

With regard to the preceding description, it is to be understood that changes may be made in detail, especially in matters of the construction materials employed and the shape, size, and arrangement of parts without departing from the scope of the present disclosure. This Specification and the embodiments described are exemplary only, with the true scope and spirit of the disclosure being indicated by the claims that follow.

What is claimed is:

1. A method of controlling superheat in a refrigerant circuit, the refrigerant circuit including a compressor, a condenser, an expander, an evaporator, a suction heat exchanger, the refrigerant circuit containing a working fluid, the method comprising:

directing a suction stream of the working fluid from the evaporator through the suction heat exchanger to the compressor;

directing a first portion of the working fluid compressed by the compressor from the compressor to the suction heat exchanger; and controlling, with a working fluid control valve, a flowrate of the first portion of the working fluid into the suction heat exchanger, which includes:

detecting properties of the working fluid, determining a target saturation temperature for the first portion of the working fluid based on a suction superheat setpoint and the detected properties of the working fluid, and modulating the working fluid control valve based on the determined target saturation temperature.

2. The method of claim 1, wherein the detecting of properties of the working fluid includes detecting a saturation temperature of the first portion of the working fluid, and the modulating of the working fluid control valve is based on a difference between the determined target saturation temperature and the detected saturation temperature of the first portion of the working fluid.

3. The method of claim 1, wherein the detecting of the properties of the working fluid includes:

detecting an inlet temperature, an outlet temperature, and a pressure of the working fluid in the suction stream flowing through the suction heat exchanger, and detecting an inlet temperature, an outlet temperature, and a pressure of the first portion of the working fluid flowing through the suction heat exchanger.

4. The method of claim 1, wherein the determining of the target saturation temperature includes determining a target log mean temperature difference for the suction heat exchanger based on the suction superheat setpoint and one or more of the detected properties of the working fluid, and the target saturation temperature is determined based on the suction superheat setpoint, the target log mean temperature difference, and a saturation temperature of the working fluid in the suction stream.

5. The method of claim 4, wherein the detecting of the properties of the working fluid includes detecting one or more of a Prandtl number, a specific heat, a dynamic viscosity, and the saturation temperature of the working fluid in the suction stream based on the detected properties of the working fluid, and the target log mean temperature difference is determined based on one or more of the detected Prandtl number, the detected specific heat, and the detected dynamic viscosity.

6. The method of claim 1, wherein the target saturation temperature is determined based on the suction superheat setpoint and one or more maximum severity properties of the suction heat exchanger.

7. The method of claim 6, wherein the one or more maximum severity properties of the suction heat exchanger correspond to when operating the compressor at a predetermined maximum mass flow rate and at a predetermined minimum compression setting at the predetermined maximum mass flow rate.

8. The method of claim 1, wherein the modulating of the working fluid control valve adjusts the working fluid control valve between different open positions.

9. The method of claim 1, wherein the suction stream of the working fluid flows through a first side of the suction heat exchanger, the first portion of the working fluid flows through a second side of the suction heat exchanger, and the first portion of the working fluid and the working fluid in the suction stream flowing through the suction heat exchanger exchange heat without physically mixing.

10. The method of claim 1, further comprising:

directing a second portion of the working fluid compressed by the compressor from the compressor through the condenser and an expander to the evaporator; and rejoining the first portion of the working fluid, after passing through the suction heat exchanger, with the second portion of the working fluid downstream of the expander and upstream of the evaporator.

11. The method of claim 10, further comprising:

directing the first portion of the working fluid, after passing through the suction heat exchanger, through a flow resistor prior to the rejoining of the first portion of the working fluid with the second portion of the working fluid.

12. The method of claim 10, further comprising:

cooling, with the condenser, the second portion of the working fluid with a first process fluid;

expanding, with the expander, the second portion of the working fluid cooled in the condenser, and heating, with the evaporator, the second portion of the working fluid expanded by the expander with a second process fluid.

13. A refrigerant circuit for a heating, ventilation, air conditioning, and refrigeration (HVACR) system, comprising:

a compressor, a condenser, an expander, an evaporator, and a suction heat exchanger being fluidly connected, a main flow path extending from the compressor through the condenser, the expander, the evaporator, and the suction heat exchanger, and back to the compressor;

a bypass flow path extending through the suction heat exchanger, the bypass flow path extending from the main flow path downstream of the compressor and upstream of the condenser in the main flow path, the bypass flow path extending to the main flow path downstream of the expander and upstream of the suction heat exchanger;

a working fluid control valve for controlling flow of working fluid through the bypass flow path;

one or more sensors;

a controller for the refrigerant circuit, the controller configured to:

detect, using the one or more sensors, properties of the working fluid, determining a target saturation temperature for the working fluid in the bypass flow path flowing through the suction heat exchanger based on a predetermined suction superheat setpoint and the detected properties of the working fluid, and modulate the working fluid control valve based on the determined target saturation temperature.

14. The refrigerant circuit of claim 13, wherein the controller is configured to modulate the working fluid control valve based on a difference between a detected saturation temperature of the working fluid in the bypass flow path and the determined target saturation temperature.

15. The refrigerant circuit of claim 13, wherein the controller being configured to detect the properties of the working fluid includes the controller being configured to detect, using a pressure sensor of the one or more sensors, a pressure of the working fluid in the bypass flow path, and the controller is configured to determine a detected saturation temperature from the pressure of the working fluid in the bypass flow path detected by the pressure sensor.

16. The refrigerant circuit of claim 15, wherein the controller is configured to:

detect one or more of a Prandtl number, a specific heat, a dynamic viscosity of the working fluid flowing through the suction heat exchanger in the main flow path, to detect the properties of the working fluid, and determine a target log mean temperature difference for the suction heat exchanger based on the predetermined suction superheat setpoint and one or more of the Prandtl number, the specific heat, and the dynamic viscosity of the working fluid flowing through the suction heat exchanger in the main flow path, and wherein the target saturation temperature is determined based on the predetermined suction superheat setpoint, the target log mean temperature difference, and the saturation temperature.

17. The refrigerant circuit of claim 13, wherein the target saturation temperature is determined based on the predetermined suction superheat setpoint and one or more maximum severity properties for the suction heat exchanger.

18. The refrigerant circuit of claim 13, wherein the suction heat exchanger includes a first side and a second side, the main flow path extending through the first side of the suction heat exchanger, and the bypass flow path extending through the second side of the suction heat exchanger.

19. The refrigerant circuit of claim 13, further comprising:

a flow resistor disposed in the bypass flow path downstream of the suction heat exchanger.

* * * * *